United States Patent [19]

Edwards

[11] 3,943,991

[45] Mar. 16, 1976

[54] METHOD AND APPARATUS FOR PREPARING FOUNDRY MOULDS OR CORES

[75] Inventor: Albert Edwards, Peterborough, England

[73] Assignee: Baker Perkins Holdings Limited, England

[22] Filed: Apr. 14, 1975

[21] Appl. No.: 567,890

Related U.S. Application Data

[63] Continuation of Ser. No. 376,431, July 5, 1973, abandoned.

[30] Foreign Application Priority Data

July 14, 1972 United Kingdom ..... 33003/72

[52] U.S. Cl. ..... 164/21; 164/193

[51] Int. Cl.[2] ..... B22C 5/12

[58] Field of Search ..... 259/148, 151; 164/20, 21, 164/192, 193, 200

[56] References Cited

UNITED STATES PATENTS

| | | | |
|---|---|---|---|
| 3,590,906 | 7/1971 | Bayliss et al. | 164/200 |
| 3,682,448 | 8/1972 | Kedzior | 259/148 |
| 3,704,743 | 12/1972 | Edwards | 164/21 |
| 3,779,520 | 12/1973 | Edwards | 259/151 |

FOREIGN PATENTS OR APPLICATIONS

| | | | |
|---|---|---|---|
| 1,051,651 | 12/1966 | United Kingdom | 164/21 |
| 1,286,162 | 8/1972 | United Kingdom | 164/21 |
| 2,055,274 | 5/1971 | Germany | 164/200 |

*Primary Examiner*—R. J. Shore
*Assistant Examiner*—John E. Roethel
*Attorney, Agent, or Firm*—Larson, Taylor and Hinds

[57] ABSTRACT

A method and apparatus for preparing relatively large size foundry moulds and cores from cold-setting foundry sand mixtures wherein successive batches of sand and binder on the one hand with sand and catalyst on the other hand are mixed in a chamber having a rotary mixing element. The batches are discharged from the chamber by gravity into a mould or core box and the chamber is purged by a blast of compressed gas between the successive mixing operations.

10 Claims, 1 Drawing Figure

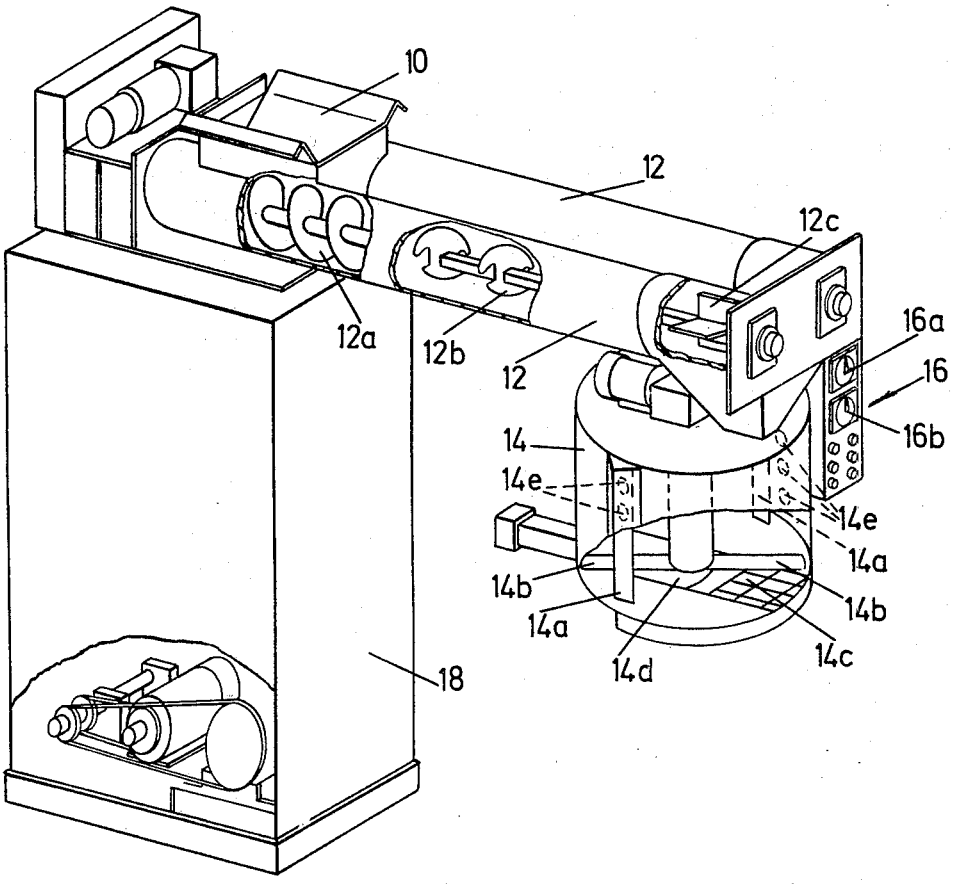
10
12
12c
12a
12b
12
16a
16
16b
14
14e
14e
14a
14b
14a
14b
14c
14d
18

METHOD AND APPARATUS FOR PREPARING FOUNDRY MOULDS OR CORES

This is a continuation of application Ser. No. 376,431 filed July 5, 1973, now abandoned.

This invention relates to a method and apparatus for preparing foundry moulds or cores.

Until now it has been difficult to prepare moulds of larger than 30 lbs in weight from cold-setting foundry sand mixtures. It is an object of the present invention to provide a method and apparatus capable of preparing such moulds or cores in a large range of sizes up to about 500 lbs in weight.

According to the invention there is provided a method of preparing a foundry mould or core from a cold-setting foundry sand mixture comprising mixing successive batches of sand and binder mixture on the one hand with sand and catalyst mixture on the other hand in a mixing chamber, discharging the successive batches into a core or mould box and purging the mixing chamber with compressed gas between the successive mixing operations.

The invention further provides apparatus for preparing foundry moulds or cores from cold-setting foundry sand mixtures, comprising means for supplying successive batches of sand and binder mixture on the one hand and sand and catalyst mixture on the other hand to a mixing chamber, outlet means in the mixing chamber for discharging the successive batches into a mould or core box, means for supplying a blast of compressed gas to the mixing chamber for purging the chamber between successive mixing operations, and control means for controlling the number of batches and the weight of each batch supplied to the mixing chamber.

The invention will now be described, by way of example, with reference to the accompanying drawing which is a perspective view partly broken away of a machine for preparing foundry moulds and cores.

The apparatus comprises two horizonatlly disposed mixer and conveyor units 12 for conveying sand and binder mixture and sand and catalyst mixture respectively to a final mixer 14. Control means 16 is provided to control the number of successive batches and weight of each batch of sand and binder mixture on the one hand and sand and catalyst mixture on the other hand being supplied to the mixing chamber for successive mixing and discharging into a mould or core box, the number and weight of the batches depending on the size of the mould or core being prepared.

The mixer conveyor units 12 are of the type described in U.K. patent specification No. 1,051,651, having internal mixer conveyor elements commencing with feed screw sections 12*a* merging into mixer blade sections 12*b* (the blades being successively oppositely tilted lobed blades) and terminating in diametrically extending metering paddle blades 12*c*. Units 12 are supplied with foundry sand at a controlled rate by feed arrangements 10 of the type disclosed in U.K. patent specification No. 1,286,162 i.e. each barrel has a side opening surrounded by a rotatable sleeve capable of varying the size of the opening which is formed at the base of a sand hopper. surrounding the barrel. Accordingly when the mixer element rotates sand is drawn into the barrel through the opening at a controlled rate dependent on the size of the opening. Each barrel is also provided with conventional means for the supply of a binder on the one hand and a catalyst on the other hand each at a controlled rate.

The final mixer 14 is of the type disclosed in U.S. Pat. No. 3,779,520. The mixer employs a vertical rotary mixing element having diametrically opposed vertical spring steel blades 14*a* adapted during mixing to sweep the roof and the vertical cylindrical wall of the mixer chamber and angularly offset horizontal blades 14*b* adapted to sweep the base of the mixer. The individual sand mixtures from units 12 enter the final mixer through an inlet in the roof and the final mixture is discharged from an outlet 14*c* in the base which can be in line with or offset from the inlet and controlled by a sliding door 14*d*. The final mixer has diametrically opposed vertical rows of tangentially extending air inlets 14*e* in the cylindrical wall for the admission of compressed purging air from a suitable source such as a ring main.

The whole mixing and conveying arrangement, comprising the mixer and conveyor units 12 and mixing chamber 14, is mounted on a pedestal 18 and discharge of the cold-setting mixture is effected by gravity from the final mixer outlet directly into the mould or core box.

A vibrator table (not shown) may be provided for supporting the mould or core box to give additional compaction of the mixture in the mould or core box. The vibratory table may be pivotally mounted in order to move the mould or core box under the mixing chamber outlet.

Successive batches of sand and resin mixture on the one hand and sand and catalyst mixture on the other hand are supplied simultaneously to the mixing chamber 14 by means of the mixer and conveyor units 12. For a specific mould or core, the desired number of batches and weight of each batch are determined beforehand and by setting the control means 16, which comprises a batch control dial 16*a* and a quantity dial 16*b* controlling the weight per batch. The dials are calibrated, dial 16*a* in numbers of batches and dial 16*b* in numbers of "counts", a certain number of counts representing that number of revolutions of the units 12 and thus controlling the weight per batch.

The separate batches of sand and resin and sand and catalyst mixes are intermixed in the final mixer 14 for a predetermined period of time and then discharged directly into the mould or core box by opening the outlet at the bottom of the mixing chamber and allowing the final mixture to fall out under gravity with the aid of agitation by the rotary mixing element in the chamber.

Immediately after the mixture is discharged, the mixing chamber is purged by applying compressed air to the chamber before the next batch is delivered to the chamber. The successive discharges are timed so that detrimental layering between successive batches in the mould or core box does not occur.

For a 150 lb. core for example the "batch" dial may be set to the number 3 and the "quantity" dial set to 20 counts corresponding to 50 lbs. Having set the two dials and positioned a suitable core box beneath the discharge outlet of the machine, the operator presses in a button on the control panel for the cycle to commence. The discharge door of the final mixer closes and in so doing 'makes' a switch to start the two primary mixer and feeders 12. Every quarter of a revolution of the primary mixer shafts is counted (i.e. 4 counts to 1 revolution) through the media of a disc (not shown)

mounted on the end of one of the shafts. The disc has four magnets spaced angularly at 90° from each other and as the shaft rotates the magnets pass in close proximity to a reed switch which completes an electrical circuit as each magnet passes it, thus, reducing the count on the "quantity" dial by one at each pass. When the counter reaches zero the two primary mixer and feeders stop. By the provision of a suitable electrical circuitry, an electronic timer is then actuated which allows a predetermined time dwell before the discharge door of the final mixer opens. The purpose of the time dwell is for the final mixing stage e.g. 5 secs. to be completed. In opening, the door trips a limit switch and returns the "quantity" dial pointer back to the original setting (i.e. 20 counts) and also counts one batch on the "batch" dial. A further timer is actuated which allows a delay on the purge control, thus allowing the final mixer to discharge its contents. After this predetermined delay, a still further timer is actuated to commence the air purging state, the air being supplied from a suitable source (not shown) through the purging inlets 14*e*. After a predetermined delay the air purging ceases and by so doing signals the discharge door of the final mixer to be closed for the next cycle. The whole cycle is repeated for two further batches and the operation is then completed when the batch dial has counted off three batches.

One advantage of the invention is that the quicker setting times obtained by the use of coldsetting mixtures can be utilized for the production of larger moulds or cores. Another advantage is that a minimum amount of cleaning of the mixing chamber is required in view of the air purging between successive mixing operations.

I claim:

1. A method of preparing a foundry mould or core from a cold-setting foundry sand mixture comprising the steps of a. feeding a batch of sand and binder mixture in a first feed unit to a mixing chamber.

b. simultaneously feeding a batch of sand and catalyst mixture in a second feed unit to the mixing chamber.

c. mixing the batch of sand and binder mixture with the batch of sand and catalyst mixture in the mixing chamber, d. discharging the mixed batches from the mixing chamber into a mould or core box under gravity, e. purging the mixing chamber with compressed gas, f. repeating steps (a) through (e) until a predetermined number of mixed batches are discharged into the mould or core box.

2. A method as claimed in claim 1 wherein the batches of sand and binder and sand and catalyst supplied to the mixing chamber by separate feed units each employing a rotary feed element.

3. A method as claimed in claim 2 wherein the weight of each batch is controlled by operating the feed elements for a controlled number of revolutions.

4. A method as claimed in claim 3 wherein the weight of a mould or core is controlled by controlling the number of batches and weight per batch.

5. Apparatus for preparing a foundry mould or core from a cold-setting foundry sand mixture comprising a first feed unit for a batch of sand and binder mixture, a second feed unit for a batch of sand and catalyst mixture, a mixing chamber, means for simultaneously feeding said batch of sand and binder mixture and said batch of sand and catalyst mixture to said mixing chamber, a mould or core box, outlet means in the mixing chamber for discharging the mixed batches into said mould or core box by gravity, means for supplying a blast of compressed gas to the mixing chamber for purging the chamber between successive mixing operations and control means for controlling the number of batches and weight of each batch supplied to the mixing chamber.

6. Apparatus as claimed in claim 5 including a pair of rotary element feed units for supplying the sand and binder mixture on the one hand and the sand and catalyst mixture on the other hand to the mixing chamber.

7. Apparatus as claimed in claim 6 wherein the means for controlling the weight of each batch comprises means for operating the rotary elements for a controlled number of revolutions.

8. Apparatus as claimed in claim 7 wherein the mixing chamber includes a rotary mechanical mixing element.

9. Apparatus as claimed in claim 8 wherein the mixing element has a first pair of blades adapted to sweep the roof and an inner vertical cylindrical wall of the chamber and a second pair of blades angularly offset from the first pair and adapted to sweep the base of the chamber respectively.

10. Apparatus as claimed in claim 9 wherein the mixing chamber has an inlet in the roof and an outlet in the base aligned with or offset from the inlet.

* * * * *